US008703684B2

(12) United States Patent
Kakuchi et al.

(10) Patent No.: US 8,703,684 B2
(45) Date of Patent: Apr. 22, 2014

(54) AQUEOUS LUBRICANT

(75) Inventors: Toyoji Kakuchi, Hokkaido (JP); Toshifumi Satoh, Hokkaido (JP); Ryosuke Sakai, Hokkaido (JP); Fumiaki Takagi, Chiba (JP); Masami Yamanaka, Chiba (JP)

(73) Assignee: Idemitsu Kosan Co., Ltd., Tokyo (JP)

( * ) Notice: Subject to any disclaimer, the term of this patent is extended or adjusted under 35 U.S.C. 154(b) by 184 days.

(21) Appl. No.: 13/255,663

(22) PCT Filed: Aug. 28, 2009

(86) PCT No.: PCT/JP2009/065087

§ 371 (c)(1),
(2), (4) Date: Oct. 18, 2011

(87) PCT Pub. No.: WO2010/103681

PCT Pub. Date: Sep. 16, 2010

(65) Prior Publication Data

US 2012/0040877 A1 Feb. 16, 2012

(30) Foreign Application Priority Data

Mar. 13, 2009 (JP) ..... 2009-062069

(51) Int. Cl.
*C10M 107/30* (2006.01)
*C10M 173/02* (2006.01)
*C07C 43/13* (2006.01)

(52) U.S. Cl.
USPC ..... 508/579; 568/623; 568/624; 568/625; 72/42

(58) Field of Classification Search
USPC ..... 508/579; 568/623, 624, 625; 72/42
See application file for complete search history.

(56) References Cited

U.S. PATENT DOCUMENTS

| | | | | |
|---|---|---|---|---|
| 4,061,684 | A * | 12/1977 | Helfert et al. | 568/613 |
| 4,265,774 | A * | 5/1981 | Langdon | 508/579 |
| 4,960,953 | A * | 10/1990 | Jakobson et al. | 568/621 |
| 7,196,145 | B2 * | 3/2007 | Ignatious | 525/523 |
| 8,017,814 | B2 * | 9/2011 | Hasselaar et al. | 568/620 |
| 2008/0007588 | A1 | 1/2008 | Yoshimura | |
| 2009/0130006 | A1 * | 5/2009 | Wang et al. | 423/111 |
| 2012/0101308 | A1 * | 4/2012 | Montero Pancera et al. | 568/624 |

FOREIGN PATENT DOCUMENTS

| | | |
|---|---|---|
| JP | 8 176586 | 7/1996 |
| JP | 8 231977 | 9/1996 |
| JP | 8 239683 | 9/1996 |
| JP | 10 324888 | 12/1998 |
| JP | 2002 226879 | 8/2002 |
| JP | 2007 297558 | 11/2007 |

OTHER PUBLICATIONS

Tamaki, M. et al., "Synthesis and Functionalization of High Molecular Weight Hyperbranched Polyglycerol", The Society of Polymer Science, vol. 57, No. 2, pp. 2406-2407, (Sep. 9, 2008).
International Search Report Issued Nov. 17, 2009 in PCT/JP09/065087 filed Aug. 28, 2009.

* cited by examiner

*Primary Examiner* — Ellen McAvoy
(74) *Attorney, Agent, or Firm* — Oblon, Spivak, McClelland, Maier & Neustadt, L.L.P.

(57) ABSTRACT

Provided is a water-based lubricant comprising a hyperbranch-type polyglycerol having an absolute molecular weight of from 5,000 to 500,000. The water-based lubricant has a small friction coefficient and is excellent in lubrication performance and defoamability, as compared with conventional water-based lubricants comprising an ethylene/propylene oxide copolymer, and is favorable, for example, for a water-based metal processing agent and a hydraulic pressure fluid.

16 Claims, 1 Drawing Sheet

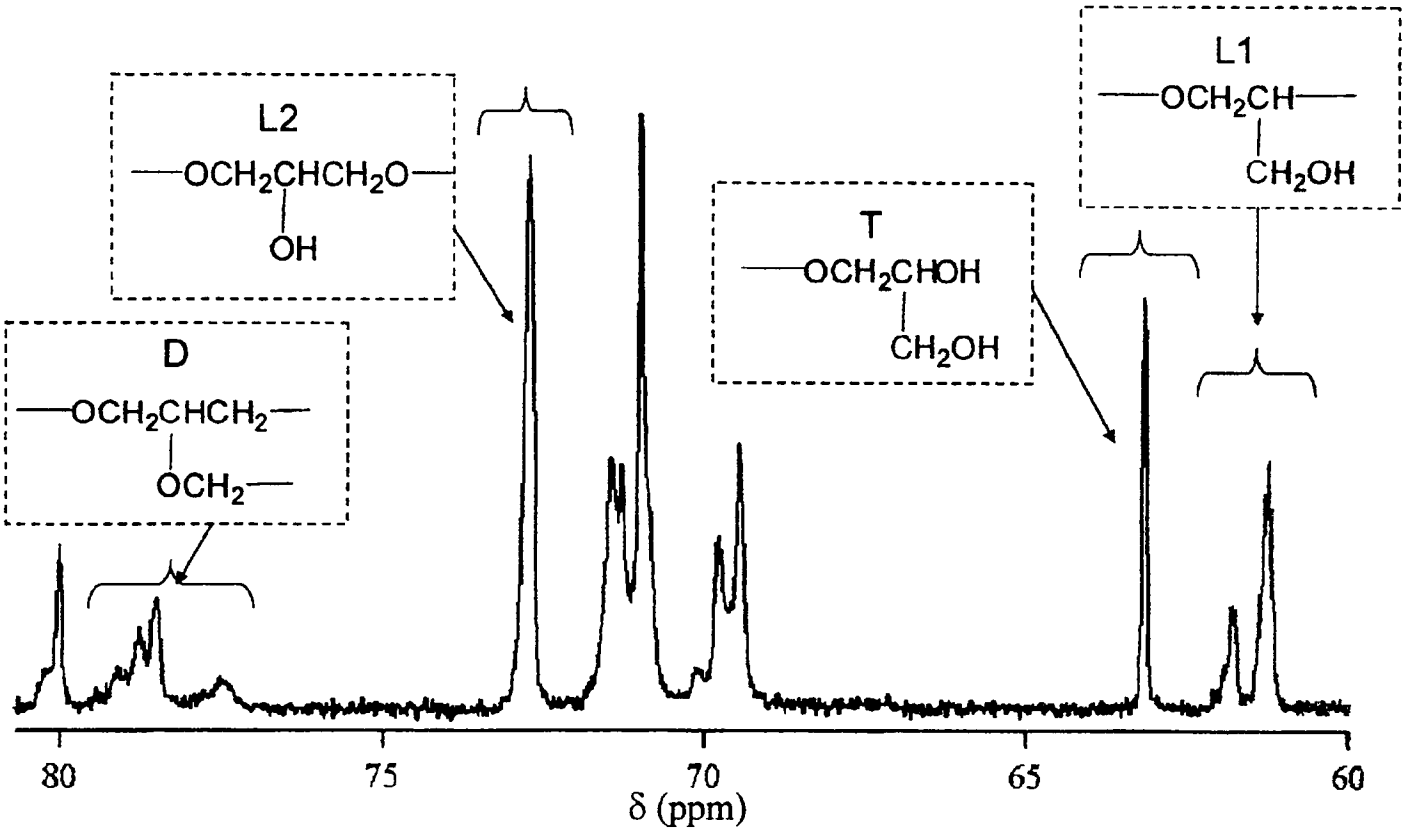
L1
—OCH2CH—
CH2OH
T
—OCH2CHOH
CH2OH
L2
—OCH2CHCH2O—
OH
D
—OCH2CHCH2—
OCH2—
60
65
70
75
80
δ (ppm)

AQUEOUS LUBRICANT

TECHNICAL FIELD

The present invention relates to a water-based lubricant, more precisely to a water-based lubricant having a small friction coefficient and excellent in lubrication performance and defoamability, as compared with a conventional water-based lubricant comprising an ethylene oxide/propylene oxide copolymer, which is favorable, for example, for a water-based metal processing agent, a hydraulic pressure fluid, etc.

BACKGROUND ART

Recently, in the field of metal processing oil, hydraulic oil and others, widely used is a water-based lubricant oil for the purpose of preventing lubricant oil leakage and heat generation and for preventing fire owing to lubricant oil scattering. In a water-based lubricant oil such as typically a solution-type cutting oil or a water-glycol-based hydraulic oil, used is a polyether compound as a lubricity enhancer and a viscosity improver. The water-based lubricant comprising a polyether compound is advantageous in that its appearance is transparent, it is noncombustible, it is highly stable at a high temperature and it is free from troubles of separation and decay. As the polyether compound for such applications, much used is a random copolymer of ethylene oxide and propylene oxide. There is known another example of using a block polymer of ethylene oxide and propylene oxide as a poorly-foamable polyether compound; and for example, Patent Document 1 discloses a metal processing oil composition containing a so-called reverse-block-type polyether produced by adding propylene oxide to polyethylene glycol. Patent Document 2 discloses a water-soluble cutting oil composition containing a PO-EO-PO structure (where PO means an oxypropylene group, and EO means an oxyethylene group) block-type polyoxyalkylene compound, a fatty acid having from 8 to 10 carbon atoms, and a basic compound.

However, all such polyether compounds heretofore used in the art are not fully satisfactory in point of the lubrication performance and the defoamability thereof.

On the other hand, recently, studies and developments of dendritic polymer compounds have been positively made as the hyperbranch structures of those compounds can promote expression of various functions and wide-range application and development thereof can be expected. The dendritic polymer compounds may be grouped into a dendrimer and a hyperbranch-type polymer.

The hyperbranch-type polymer is a generic term for hyperbranch polymer compounds having a branched structure in the recurring unit thereof. The dendrimer is a monomolecular compound precisely controlled through poly-stage synthetic reaction, while the hyperbranch-type polymer is a synthetic polymer compound generally obtained in a single-stage polymerization process.

Regarding the hyperbranch-type polymer, a hyperbranch-type polymer produced through ring-opening polymerization is known. The polymerization is referred to as multibranching polymerization in which the monomer itself does not have a branch and the branch in the resulting polymer is formed through ring-opening reaction.

As one example of the hyperbranch-type polymer produced through ring-opening polymerization, a hyperbranch-type polyether is reported, which is produced through ring-opening reaction of a cyclic ether for branch formation and molecular chain growth (for example, see Non-Patent Documents 1 and 2). According to this report, a hyperbranch-type polyglycerol is produced through anionic ring-opening polymerization of glycidol using a potassium alkoxide/initiator system. As the initiator, for example, used is 1,1,1-tris(hydroxymethyl)propane, 1-dibenzylamino-2,3-dihydroxypropane, or the like; and a hyperbranch-type polyglycerol having an absolute molecular weight of from 1,000 to 1,000,000 and a degree of molecular weight dispersion of smaller than 1.8 is produced.

However, the method is problematic in that a branched structure is used as the initiator, the method requires complicated operation and its reproducibility is poor, and the physical properties of the polymer comprising pure monomer units are not clear.

Glycidol has one epoxy group and one hydroxyl group, and therefore it may be considered as a latent $AB_2$-type monomer.

It is also reported to produce a hyperbranch-type polyglycerol through cationic ring-opening polymerization of glycidol using a cationic reagent (for example, see Non-Patent Document 3). In this case, however, the produced hyperbranch-type polyglycerol has some problems in that the molecular weight thereof is from 700 to 10,000 or so and is small and the degree of molecular weight dispersion thereof is larger than 2, and these are difficult to control.

PRIOR ART REFERENCES

Patent Documents

[Patent Document 1] JP-A 8-231977
[Patent Document 2] JP-A 8-239683

Non-Patent Documents

[Non-Patent Document 1] Reviews in Molecular Biotech., 2002, 90, 257-267
[Non-Patent Document 2] Macromolecules, 2006, 39, 7708-7717
[Non-Patent Document 3] Macromolecules, 1994, 27, 320-322

SUMMARY OF THE INVENTION

Problems that the Invention is to Solve

The present invention has been made in that situation, and its object is to provide a water-based lubricant having a small friction coefficient and excellent in lubrication performance and defoamability, as compared with a conventional water-based lubricant comprising an ethylene oxide/propylene oxide copolymer, which is favorable, for example, for a water-based metal processing agent, a hydraulic pressure fluid, etc.

Means for Solving the Problems

The present inventors have assiduously studied for the purpose of attaining the above-mentioned object, and, as a result, have reached the following findings.

The present inventors have found that a water-based lubricant comprising a hyperbranch-type polyglycerol with an absolute molecular weight falling within a specific range can satisfy the object, and that the hyperbranch-type polyglycerol can be produced through specific ring-opening polymerization of latent $AB_2$-type glycidol using a $BF_3$ complex as the initiator, in which the molecular weight and the degree of molecular weight dispersion of the resulting polymer are controllable. The present invention has been completed on the basis of these findings.

Specifically, the present invention provides the following:

(1) A water-based lubricant comprising a hyperbranch-type polyglycerol having an absolute molecular weight of from 5,000 to 500,000;

(2) The water-based lubricant of the above (1), wherein the absolute molecular weight of the hyperbranch-type polyglycerol is from 5,000 to 300,000;

(3) The water-based lubricant of the above (1) or (2), wherein the degree of branching (DB) of the hyperbranch-type polyglycerol falls within a range of from 0.40 to 0.65;

(4) The water-based lubricant of any of the above (1) to (3), wherein the hyperbranch-type polyglycerol satisfies the following formula (1) where α is less than 0.5:

$$[\eta]=K\cdot M^{\alpha} \quad (1)$$

(wherein [η] means the intrinsic viscosity or the limiting viscosity of the polymer; K is a constant; M is the absolute molecular weight of the polymer);

(5) The water-based lubricant of any of the above (1) to (4), wherein the hyperbranch-type polyglycerol is produced through ring-opening polymerization of glycidol using a $BF_3$ complex as the initiator;

(6) The water-based lubricant of any of the above (1) to (5), which is used as a water-based metal processing agent;

(7) The water-based lubricant of the above (6), wherein the water-based metal processing agent is for plastic working, cutting or grinding;

(8) The water-based lubricant of any of the above (1) to (5), which is used as a hydraulic pressure fluid;

(9) The water-based lubricant of any of the above (1) to (8), which is an aqueous solution type or emulsion type one further containing at least one selected from oily agent, friction reliever, extreme-pressure agent, antioxidant, cleaning agent, dispersing agent, defoaming agent, surfactant, rust inhibitor, preservative, corrosion inhibitor, solvent and basic compound.

Advantage of the Invention

According to the present invention, there is provided a water-based lubricant comprising a hyperbranch-type polyglycerol with an absolute molecular weight falling within a specific range, which has a small friction coefficient and is excellent in lubrication performance and defoamability, as compared with a conventional water-based lubricant comprising an ethylene oxide/propylene oxide copolymer, and which is favorable, for example, for a water-based metal processing agent, a hydraulic pressure fluid, etc.

BRIEF DESCRIPTION OF THE DRAWING

FIG. 1 It is a $^{13}$C-NMR spectrum for computing the degree of branching of the hyperbranch-type polyglycerol for use in the present invention.

MODE FOR CARRYING OUT THE INVENTION

The water-based lubricant of the present invention comprises a hyperbranch-type polyglycerol having an absolute molecular weight of from 5,000 to 500,000.

The hyperbranch-type polyglycerol is a generic term for hyperbranch polymer compounds having a branched structure in the recurring unit thereof. A most popular method for producing such a hyperbranch-type polymer comprises self-polycondensation of a so-called $AB_x$-type molecule having at least three in total of two types of substituents in one molecule (where A and B means different functional groups).

[Hyperbranch-Type Polyglycerol]

The hyperbranch-type polyglycerol for use in the water-based lubricant of the present invention may be produced through ring-opening polymerization of glycidol. The polymerization is referred to as multibranching ring-opening polymerization (MBP or MBROP), in which the monomer glycidol itself does not have a branch and the branch in the resulting polymer is formed through ring-opening reaction.

Glycidol has one epoxy group and one hydroxyl group, and therefore it may be considered as a latent $AB_2$-type monomer for the MBP.

The hyperbranch-type polyglycerol in the present invention must have an absolute molecular weight falling within a range of from 5,000 to 500,000. When the absolute molecular weight is smaller than 5,000, then the polymer has a large kinematic friction coefficient and could not exhibit a sufficient lubrication performance; but the polymer having an absolute molecular weight or larger than 500,000 is difficult to produce. The absolute molecular weight is preferably from 5,000 to 300,000, more preferably from 8,000 to 200,000 from the viewpoint of the lubrication performance the producibility of the polymer.

The absolute molecular weight is measured through size exclusion chromatography on-line multiangle laser light scattering analysis (SEC-MALLS) using an aqueous $NaNO_3$ solution having a concentration of 0.2 mol/L as the mobile phase solvent.

The degree of branching, as measured according to the method mentioned below, of the hyperbranch-type polyglycerol is generally within a range of from 0.40 to 0.65, preferably from 0.45 to 0.55.

<Method for Measurement of Degree of Branching>

Sample Condition: 200 mg of the polymer is dissolved in 0.6 mL of heavy water.

Apparatus: 100 MHz $^{13}$C-NMR (JEOL's "JEOL JNM-A400II").

Process Condition Inversion gate-coupled $^{13}$C-NMR analysis (nne$^{13}$C-NMR), in which the pulse interval time is 7 seconds and acetone is for the standard peak (δ: 30.89 ppm).

Integration Frequency: 4000 times.

Peak Range for Integration:

L1: 60.75-62.12 ppm

T: 62.68-63.35 ppm

L2: 72.01-73.38 ppm (The integrated value of the peak contains fragments of two carbons, and this is divided into ½ in computation.)

D: 76.93-79.68 ppm

The peak ranges are as in the $^{13}$C-NMR spectrum in FIG. 1.

The degree of branching (DB) is computed from the integrated values of the peaks, according to the following formula (2):

$$\text{Degree of Branching(DB)}=2D/(2D+L1+L2/2) \quad (2)$$

Of the hyperbranch-type polyglycerol, a in the following formula (1) is generally less than 0.5, preferably from 0.1 to 0.4.

$$[\eta]=K\cdot M^{\alpha} \quad (1)$$

(wherein [η] means the intrinsic viscosity or the limiting viscosity of the polymer; K is a constant; M is the absolute molecular weight of the polymer).

The above-mentioned [η] and the absolute molecular weight are measured through SEC-MALLS using an aqueous $NaNO_3$ solution having a concentration of 0.2 mol/L, as so mentioned in the above.

The ratio, standard polystyrene-equivalent molecular weight Mw/number-average molecular weight Mn of the polymer (this may be referred to as a mean molecular weight distribution or a degree of molecular weight dispersion), as measured through the above-mentioned SEC-MALLS, is generally from 1.3 to 3.5 or so.

The hyperbranch-type polyglycerol has the above-mentioned properties, and its chemical structure is, for example, a structure of the following formula (3):

[Chemical Formula 1]

(3)

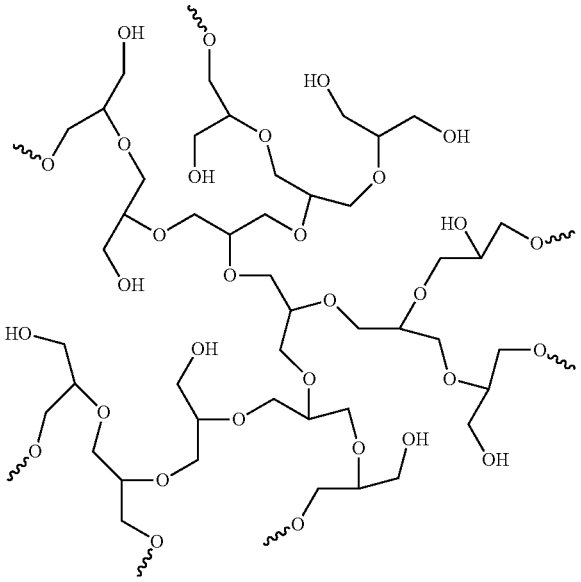

[Production of Hyperbranch-Type Polyglycerol]

The production method for the hyperbranch-type polyglycerol is not specifically defined, and may be any method capable of producing a polyglycerol having the above-mentioned properties with good reproducibility; however, methods of anionic ring-opening polymerization or cationic ring-opening polymerization of glycidol heretofore known in the art are unfavorable, as having the following problems.

For example, the method of producing a hyperbranch-type polyglycerol through anionic ring-opening polymerization of glycidol using a potassium alkoxide/initiator system (Non-Patent Document 1 mentioned above) is problematic in that a branched structure is used as the initiator, the method requires complicated operation and its reproducibility is poor, and the physical properties of the polymer comprising pure monomer units are not clear.

In the method of producing a hyperbranch-type polyglycerol through cationic ring-opening polymerization of glycidol using a cationic reagent (Non-Patent Document 3 mentioned above), the produced hyperbranch-type polyglycerol has some problems in that the molecular weight thereof is from 700 to 10,000 or so and is small and the degree of molecular weight dispersion thereof is larger than 2, and these are difficult to control.

The present inventors have assiduously studied methods of producing a hyperbranch-type polyglycerol having the above-mentioned properties with good reproducibility, and, as a result, have found that, in a method of ring-opening polymerization of glycidol using a $BF_3$ complex as the initiator, when a slow introduction mode for a monomer into the reaction system is employed and when the stirring condition is optimized, then the absolute molecular weight of the produced hyperbranch-type polyglycerol can be controlled and, in addition, the hyperbranch-type polyglycerol having the above-mentioned properties can be produced with good reproducibility.

The present inventors have further found that the hyperbranch-type polyglycerol thus produced is soluble in water and its aqueous solution has a large kinematic friction coefficient and is therefore useful as a water-based lubricant.

A preferred production method for the hyperbranch-type polyglycerol for use in the present invention is described below.

In the present invention, a latent $AB_2$-type monomer, glycidol is polymerized in a mode of ring-opening polymerization using a $BF_3$ complex as the initiator. The $BF_3$ complex used as the initiator includes, for example, $BF_3$/ethyl ether complex $[(C_2H_5)_2O.BF_3]$, $BF_3$/phenol complex $[(C_6H_5OH)_2.BF_3]$, $BF_3$/monoethylamine complex $[C_2H_5NH_2.BF_3]$, $BF_3$/n-butyl ether complex $[(n\text{-}C_4H_9)_2O.BF_3]$, etc. Of those, preferred is $BF_3$/ethyl ether complex from the viewpoint of the capability thereof as an initiator.

The solvent in the ring-opening polymerization may be an organic solvent inert to the reaction and capable of fully dissolving the initiator, the monomer glycidol, and the product hyperbranch-type polyglycerol; and methylene chloride is especially preferred.

A preferred example of concrete operation is described. Methylene chloride serving as a solvent and $BF_3$/ethyl ether complex serving as an initiator are put into a reactor equipped with a stirrer and a glycidol supply unit, and with stirring the initiator-containing solution, glycidol is gradually put into it. The amount of the $BF_3$/ethyl ether complex to be put into the reactor is from 1 to 10 mmol or so, preferably from 2 to 6 mmol per liter of the solvent.

The introduction speed of glycidol may be from 0.05 to 1.0 mol/hr or so, preferably from 0.1 to 0.5 mol/hr, per liter of the solvent. The polymerization temperature is preferably from −30 to 10° C., more preferably from −20 to 0° C.

The overall amount of glycidol to be put into the reactor may be from 300 to 1800 mols, preferably from 400 to 1600 mols per mol of the $BF_3$/ethyl ether complex from the viewpoint of the yield of the hyperbranch-type polyglycerol.

The stirring condition may be optimized depending on the size of the reactor and the shape of the stirrer. After introduction of glycidol, the system is further stirred at the polymerization temperature to continue the polymerization. The overall polymerization time could not be defined indiscriminately, as depending on the polymerization temperature, and the amount of the initiator and glycidol put into the reactor, but may be generally from 20 to 50 hours or so.

The ring-opening polymerization is attained in the manner as above and the conditions are suitably selected, whereby the absolute molecular weight of the hyperbranch-type polyglycerol to be produced can be controlled and, in addition, the hyperbranch-type polyglycerol having the above-mentioned properties can be produced with good reproducibility.

In the ring-opening polymerization, intramolecular cyclization (backbiting) may often occur under the condition where the amount of the monomer is small in the reaction system. Accordingly, in case where the introduction speed of glycidol is too low or in case where the polymerization time is too long, the intramolecular cyclization readily occurs to thereby lower the molecular weight of the produced polymer or to lower the yield thereof.

After the reaction, the hyperbranch-type polyglycerol produced through the ring-opening polymerization may be collected efficiently, for example, according to the following operation.

After the reaction is stopped with aqueous ammonia or the like, the solvent is removed through evaporation, and then the residue is dissolved in methanol, and reprecipitated in acetone, whereby the polymer having a high purity can be collected.

Next described are the properties of the water-based lubricant of the present invention, the additive ingredients thereto and the use of the lubricant.

[Water-Based Lubricant]

The water-based lubricant of the present invention comprises, as the lubricant ingredient thereof, the above-mentioned hyperbranch-type polyglycerol having an absolute molecular weight of from 5,000 to 500,000, preferably from 5,000 to 300,000, more preferably from 8,000 to 200,000.

The water-based lubricant in the present invention indicates an aqueous solution type one or an emulsion type one with water as the medium thereof.

(Properties)

The water-based lubricant of the present invention comprising, as the lubricant ingredient thereof, a hyperbranch-type polyglycerol (HPB-PGR) has a significantly low kinematic friction coefficient and exhibits excellent lubrication performance in the following reciprocating friction test, as compared with a water-based lubricant comprising, as the lubricant ingredient thereof, an ethylene oxide (EO)/propylene oxide (PO) copolymer or polyethylene glycol (PEG) that has heretofore been used as a water-based lubricant, in case where the molecular weight of the individual lubricant ingredient and the concentration thereof are nearly the same between them.

<Reciprocating Friction Test Condition>

Ball material: SUJ2 ½ inches

Sliding material: steel sheet (SPCC)

Load: 200 g

Test temperature: room temperature (23° C.)

Sliding speed: 40 mm/sec

Sliding distance: 40 mm

Sliding frequency: 20 to-and-fro times

For example, when a water-based lubricant A containing 5% by mass of HPB-PGR having an absolute molecular weight of 10,000, a water-based lubricant B containing 5% by mass of EO/PO (molar ratio 8/2) block copolymer having an absolute molecular weight of 10,250, and a water-based lubricant C containing 5% by mass of PEG having an absolute molecular weight of 10,000 are tested in a reciprocating friction test under the above-mentioned condition, then the kinematic friction coefficient on the 20th to-and-fro sliding movement of the water-based lubricant A is 0.093, while that of the water-based lubricant B is 0.154 and that of the water-based lubricant C is 0.145.

As in the above, the water-based lubricant containing HPB-PGR of the present invention has excellent lubrication performance as compared with the water-based lubricant containing EO/PO block copolymer and the water-based lubricant containing PEG that have heretofore been used in the art.

Further, the kinematic friction coefficient of the water-based lubricant containing HPB-PGR of the present invention tends to decrease with the increase in the molecular weight of the lubricant ingredient in case where the lubricant has the same concentration.

Further, the water-based lubricant of the present invention comprising HPB-PGR as the lubricant ingredient thereof exhibits excellent defoamability in the following defoamability evaluation test, as compared with a water-based lubricant comprising EO/PO block copolymer or PEG as the lubricant ingredient thereof that has heretofore been used as a water-based lubricant, in case where the molecular weight of the individual lubricant ingredient and the concentration thereof are nearly the same between them.

<Defoamability Evaluation Test>

A water-based lubricant is put into a 100-mL glass cylinder, greatly shaken for 10 seconds, and after 5 seconds, the liquid surface is visually checked for the presence or absence of remaining foams thereon, from which the lubricant is evaluated for the defoamability thereof.

For example, when the water-based lubricant A, the water-based lubricant B and the water-based lubricant C that are the same as in the above-mentioned reciprocating friction test are tested in the above-mentioned defoamability test, then the water-based lubricant A has no remaining foam after 5 seconds, but the water-based lubricant B and the water-based lubricant C still have some remaining foams after 5 seconds.

Further, an aqueous solution containing 4% by mass of EO/PO block copolymer having an absolute molecular weight of 3,420 has a clouding point of 55° C.; while an aqueous solution containing 4% by mass of HPB-PGR2 having an absolute molecular weight of 15,000, which is a water-based lubricant of the invention, does not have a clouding point, and this has excellent stability in dilution in water.

(Additive Ingredients)

The content of the hyperbranch-type polyglycerol in the water-based lubricant of the present invention is not specifically defined, and may be suitably selected depending on the use of the lubricant, but in general, the content may be from 1 to 80% by mass or so, preferably from 5 to 50% by mass.

The water-based lubricant of the present invention may contain, along with the above-mentioned hyperbranch-type polyglycerol, at least one selected from other ingredients, for example, oily agent, friction reliever, extreme-pressure agent, antioxidant, cleaning agent, dispersing agent, defoaming agent, surfactant, rust inhibitor, preservative, corrosion inhibitor, solvent and basic compound.

The water-based lubricant of the present invention may be any of an aqueous solution type one or an emulsion type one with water as the medium thereof. In case where the water-based lubricant contains any of the above-mentioned additive ingredients that could not give a uniform aqueous solution type lubricant, then it may be an emulsion type lubricant with water as the medium thereof.

<Oily Agent>

The oily agent includes, for example, alcohols such as lauryl alcohol, myristyl alcohol, palmityl alcohol, stearyl alcohol, oleyl alcohol, etc.; amides such as laurylamide, myristylamide, palmitylamide, stearylamide, oleylamide, etc. and their ethylene oxide adducts, etc. The oily agent may be in the lubricant preferably in an amount of from 0.1 to 5% by mass, more preferably from 0.1 to 3% by mass of the entire lubricant. Some of these compounds may have emulsification property or solubilization property.

<Friction Reliever>

The friction reliever includes, for example, esters such as hexanoic acid (mono, di, tri)glycerides, octanoic acid (mono, di, tri)glycerides, decanoic acid (mono, di, tri)glycerides, lauric acid (mono, di, tri)glycerides, myristic acid (mono, di, tri)glycerides, palmitic acid (mono, di, tri)glycerides, stearic acid (mono, di, tri)glycerides, oleic acid (mono, di, tri)glycerides, sorbitan fatty acid esters, etc.; ethers such as hexyl (poly)glyceryl ether, octyl (poly)glyceryl ether, lauryl (poly) glyceryl ether, stearyl (poly)glyceryl ether, oleyl (poly)glyceryl ether, etc. The friction reliever may be in the lubricant preferably in an amount of from 0.1 to 10% by mass, more preferably from 0.1 to 5% by mass of the entire lubricant. Some of these compounds may have rust-inhibiting property, emulsification property or solubilization property.

<Extreme-Pressure Agent>

The extreme-pressure agent includes lead soaps (lead naphthenate, etc.); sulfur compounds (sulfidized fatty acids such as sulfidized oleic acid, etc.; sulfidized fatty acid esters, sulfidized spam oil, sulfidized terpene, dibenzyl disulfide, amine salts or alkali metal salts of alkylthiopropionic acid having from 8 to 24 carbon atoms, amine salts or alkali metal salts of alkylthioglycolic acid having from 8 to 24 carbon atoms, etc.); chlorine compounds (chlorinated stearic acid, chlorinated paraffin, chloronaphthazantate, etc.); phosphorus compounds (tricresyl phosphate, tributyl phosphate, tricresyl phosphite, n-butyl-di-n-octyl phosphinate, di-n-butyl-di-hexyl phosphonate, di-n-butylphenyl phosphonate, dibutyl phosphoramidate, aminedibutyl phosphate, etc.). The agent may be in the lubricant preferably in an amount of from 0.1 to 10% by mass, more preferably from 0.1 to 5% by mass of the entire lubricant.

<Antioxidant>

As the antioxidant, preferably used are phenolic antioxidants and amine-based antioxidants.

The phenolic antioxidants are not specifically defined, and may be suitably selected from known phenolic antioxidants heretofore used as the antioxidant in lubricants. The phenolic antioxidants include, for example, monocyclic phenols such as 2,6-di-tert-butyl-4-methylphenol, 2,6-di-tert-butyl-4-ethylphenol, 2,4,6-tri-tert-butylphenol, 2,6-di-tert-butyl-4-hydroxymethylphenol, 2,6-di-tert-butylphenol, 2,4-dimethyl-6-tert-butylphenol, 2,6-di-tert-butyl-4-(N,N-dimethylaminomethyl)phenol, 2,6-di-tert-amyl-4-methylphenol, n-octadecyl 3-(4-hydroxy-3,5-di-tert-butylphenyl)propionate, etc.; polycyclic phenols such as 4,4'-methylenebis(2,6-di-tert-butylphenol), 4,4'-isopropylidenebis(2,6-di-tert-butylphenol), 2,2'-methylenebis(4-methyl-6-tert-butylphenol), 4,4'-bis(2,6-di-tert-butylphenol), 4,4'-bis(2-methyl-6-tert-butylphenol), 2,2'-methylenebis(4-ethyl-6-tert-butylphenol), 4,4'-butylidenebis(3-methyl-6-tert-butylphenol), 2,2'-thiobis(4-methyl-6-tert-butylphenol), 4,4'-thiobis(3-methyl-6-tert-butylphenol), etc. Of those, preferred are monocyclic phenols from the viewpoint of the effect thereof.

The amine-based antioxidants are not specifically defined, and may be suitably selected from known amine-based antioxidants heretofore used as the antioxidant in lubricants. The amine-based antioxidants include, for example, diphenylamine-type compounds, concretely diphenylamine and alkylated diphenylamines having an alkyl group with from 3 to 20 carbon atoms, such as monooctyldiphenylamine, monononyldiphenylamine, 4,4'-dibutyldiphenylamine, 4,4'-dihexyldiphenylamine, 4,4'-dioctyldiphenylamine, 4,4'-dinonyldiphenylamine, tetrabutyldiphenylamine, tetrahexyldiphenylamine, tetraoctyldiphenylamine, tetranonyldiphenylamine, etc.; as well as naphthylamine-type compounds, concretely α-naphthylamine, phenyl-α-naphthylamine, and $C_{3-20}$ alkyl-substituted phenyl-α-naphthylamines such as butylphenyl-α-naphthylamine, hexylphenyl-α-naphthylamine, octylphenyl-α-naphthylamine, nonylphenyl-α-naphthylamine, etc. Of those, diphenylamine-based compounds are preferred to naphthylamine-based compounds from the viewpoint of the effect thereof. In particular, alkylated diphenylamines having an alkyl group with from 3 to 20 carbon atoms are preferred, and 4,4'-di($C_3$-$C_{20}$ alkyl)diphenylamines are more preferred.

In the present invention, one or more different types of the above-mentioned phenolic antioxidants may be used either singly or as combined. Also one or more different types of the above-mentioned amine-based antioxidants may be used either singly or as combined. Further, at least one phenolic antioxidant and at least one amine-based antioxidant may be combined and used herein.

In the present invention, the antioxidant content may be generally from 0.05 to 2.0% by mass, preferably from 0.1 to 1% by mass of the entire lubricant, from the viewpoint of the antioxidation stability and other properties of the lubricant.

<Cleaning Agent, Dispersing Agent>

As the cleaning agent, usable is a metal-based cleaning agent; and as the dispersing agent, usable is an ash-free dispersing agent.

The metal-based cleaning agent includes, for example, neutral metal sulfonates, neutral metal phenates, neutral metal salicylates, neutral metal phosphonates, basic sulfonates, basic phenates, basic salicylates, perbasic sulfonates, perbasic salicylates, perbasic phosphonates, etc. One or more these metal-based cleaning agents may be used herein either singly or as combined.

The ash-free dispersing agent includes, for example, succinimides, boron-containing succinimides, benzylamines, boron-containing benzylamines, succinates, mono- or di-carbonamides of typically fatty acids or succinic acid, etc. Of those, preferred are succinimides; and more preferred are polyalkenylsuccinimides. One or more these ash-free dispersing agents may be used herein either singly or as combined. The total amount of the metal-based cleaning agent and the ash-free dispersing agent that may be in the lubricant is preferably from 0.1 to 20% by mass, more preferably from 0.5 to 10% by mass of the entire lubricant.

<Defoaming Agent>

As the defoaming agent, preferred is a polymer silicone-based defoaming agent. Containing a polymer silicone-based defoaming agent, the lubricant may effectively exhibit its defoamability.

The polymer silicone-based defoaming agent includes, for example, organopolysiloxanes; and especially preferred are fluorine-containing organopolysiloxanes such as trifluoropropylmethylsilicone oil, etc. From the viewpoint of the balance between the defoaming effect and the economical aspect, the content of the polymer silicone-based defoaming agent is preferably from 0.01 to 0.5% by mass, more preferably from 0.05 to 0.3% by mass of the entire lubricant.

<Surfactant>

The surfactant includes, for example, polyethylene glycol monoalkyl(aryl)ethers, polyethylene glycol polypropylene glycol monoalkyl(aryl)ethers, polyethylene glycol dialkyl (aryl)ethers, polyoxyethylene/polyoxypropylene block copolymers, polyol esters, alkanolamides, alkylsulfonic acid salts, (alkyl)benzenesulfonic acid salts, petroleum sulfonates, long-chain primary amine salts, alkyltrimethylammonium-salts, dialkyldimethylammonium salts, alkyldimethylbenzylammonium salts, alkylpyridinium salts, acylaminoethyldiethylamine salts, etc. From the viewpoint of foaming inhibition, the surfactants of good foamability are undesirable for use herein. The surfactant may be in the lubricant preferably in an amount of from 0.1 to 20% by mass, more preferably from 0.1 to 10% by mass of the entire lubricant.

Some of those surfactants may serve also as an emulsifier in preparing emulsion-type water-based lubricants.

<Rust Inhibitor>

The rust inhibitor includes, for example, aliphatic carbonamides having from 14 to 36 carbon atoms (myristylamide, palmitylamide, oleylamide, etc.); alkenylsuccinamides having from 6 to 36 carbon atoms (octenylsuccinamide, dodecenylsuccinamide, pentadecenylsuccinamide, octenylsuccinamide, etc.); cyclohexylamine nitrites; benzotriazole; mercaptobenzothiazole; N,N'-disalicylidene-1,2-diaminopropane; alizarin; aliphatic amines and their alkyleneoxide (AO) adducts, etc.

Of those, preferred are aliphatic amine AO adducts; and more preferred are triethanolamine or ethylenediamine propylene oxide (PO) (2 to 8 mols, especially 4 mols) adducts, and diethylenetriamine PO (3 to 8 mols, especially 5 mols) adducts.

Aliphatic carbonamides having from 14 to 36 carbon atoms and alkenylsuccinamides having from 6 to 36 carbon atoms function also as an oiliness enhancer. The rust inhibitor may be in the lubricant preferably in an amount of from 0.01 to 5% by mass, more preferably from 0.03 to 1% by mass of the entire lubricant.

<Corrosion Inhibitor>

The corrosion inhibitor includes, for example, benzotriazole-type, tolyltriazole-type, thiadiazole-type and imidazole-type compounds. The inhibitor may be in the lubricant preferably in an amount of from 0.01 to 5% by mass, more preferably from 0.03 to 1% by mass of the entire lubricant.

<Preservative, Antimicrobial Agent>

The preservative/antimicrobial agent may be conventional known compounds, including, for example, phenolic compounds such as o-phenylphenol, o-phenylphenol Na salt, 2,3,4,6-tetrachlorophenol, o-benzyl-p-chlorophenol, p-chloro-m-xylenol, etc.; formaldehyde donor compounds such as 2-hydroxymethyl-2-nitro-1,3-propanediol, hexahydro-1,3,5-tris(2-hydroxyethyl)-s-triazine, hexahydro-1,3,5-triethyl-s-triazine, 1-(3-chloroallyl)-3,5,7-triaza-1-azoniaadamantane, etc.; salicylanilide compounds; and other compounds such as methylenebis thiocyanate, 6-acetoxy-2,4-dimethyl-m-dioxane, 5-chloro-2-methyl-4-isothiazolin-3-one, 2-methyl-4-isothiazolin-3-one, 4-(2-nitrobutyl)morpholine, 4,4'-(2-ethyl-2-nitrotrimethylene)dimorpholine, etc.

<Solvent>

The solvent includes, for example, methanol, ethanol, 2-propanol, ethylene glycol monomethyl ether, ethylene glycol monobutyl ether, diethylene glycol monomethyl ether, diethylene glycol monobutyl ether, acetone, methyl ethyl ketone, methyl isobutyl ketone, ethylene glycol, diethylene glycol, triethylene glycol, propylene glycol, dipropylene glycol, glycerin, sorbitol, low-molecular polyether, polyethylene glycol, polypropylene glycol, polyethylene glycol mono (methyl, ethyl, propyl, butyl)ether, polypropylene glycol mono(methyl, ethyl, propyl, butyl)ether, polyethylene polypropylene (random, block) glycol mono (methyl, ethyl, propyl, butyl)ether, polyethylene glycol polyalcohol (glycerin, sorbitan, trimethylolpropane) ether, polypropylene glycol polyalcohol (glycerin, sorbitan, trimethylolpropane) ether, polyethylene glycol polyalcohol (glycerin, sorbitan, trimethylolpropane) ether, polyethylene polypropylene (block, random) glycol polyalcohol (glycerin, sorbitan, trimethylolpropane) ether, etc. The solvent may be in the lubricant preferably in an amount of from 0.1 to 50% by mass, more preferably from 0.5 to 40% by mass of the entire lubricant.

<Basic Compound>

The basic compound includes, for example, metal hydroxides such as lithium hydroxide, sodium hydroxide, potassium hydroxide, magnesium hydroxide, calcium hydroxide, etc.; ammonia; (cyclo)hydrocarbylamines such as methylamine, dimethylamine, ethylamine, diethylamine, (iso)propylamine, di(iso)propylamine, butylamine, dibutylamine, hexylamine, cyclohexylamine, octylamine, 2-ethylhexylamine, isononylamine, etc.; polyalkylenepolyamines such as ethylenediamine, propylenediamine, diethylenetriamine, dipropylenetriamine, triethylenetetramine, tetraethylenepentamine, pentaethylenehexamine, etc.; cyclic amines such as pyridine, piperazine, etc.; alkanolamines such as monoethanolamine, diethanolamine, triethanolamine, monopropanolamine, dipropanolamine, tripropanolamine, N-cyclohexyldiethanolamine, N,N,N',N'-tetrakis(hydroxyethyl)ethylenediamine, N,N,N',N'-tetrakis(2-hydroxypropyl)ethylenediamine, etc. The compound may be in the lubricant preferably in an amount of from 0.1 to 10% by mass, more preferably from 0.1 to 5% by mass of the entire lubricant. The basic compound is effective for neutralizing the acidic friction reliever (fatty acids, carboxylic acids, etc.) to thereby enhance the effect of the reliever and for increasing the pH level of the lubricant to thereby prevent the water-based lubricant of the present invention from being decayed owing to the growth of microorganisms therein. The amines may serve also as a preservative and a corrosion inhibitor.

(Use)

The water-based lubricant of the present invention is an aqueous solution-type lubricant or an emulsion-type lubricant with water as the medium thereof, containing the above-mentioned hyperbranch-type polyglycerol and optionally at least one selected from the above-mentioned various additive ingredients; and for example, it may be used as a water-based metal processing agent or a hydraulic pressure fluid.

<Water-Based Metal Processing Agent>

The water-based metal processing agent to which the water-based lubricant of the present invention is applied is used as a water-based metal processing agent for plastic working, cutting or grinding of metals.

The properties that the water-based metal processing agent must have include lubrication performance, poor foamability, water dilution stability (stability of dilution with water prepared before use), and oil separability from other mineral oil-based processing oils.

Regarding the water-based metal processing agent, a water-based lubricant that comprises, as the lubricant ingredient thereof, an ethylene oxide/propylene oxide block copolymer or polyethylene glycol has heretofore been used; however, the lubricant could not be fully satisfactory in point of the lubrication performance, the poor foamability and the water dilution stability.

As opposed to this, the water-based metal processing agent comprising the water-based lubricant of the present invention is excellent in the lubrication performance, the poor foamability and the water dilution stability.

In the water-based metal processing agent, the hyperbranch-type polyglycerol concentration in use may be generally from 10 to 80% by mass or so, preferably from 20 to 50% by mass.

<Hydraulic Pressure Fluid>

When a combustible hydraulic pressure fluid is used in hydraulic power systems such as hydraulic equipment, hydraulic apparatus and others, for example, in construction machines, working machines, plastic processing machines, robot welders in automobile assembly equipment, iron and steel equipment, die-cast machines, etc., there is a risk of fire; and therefore, a flame-retardant, water-based hydraulic pressure fluid is used in these. One typical example of the case includes a water-based lubricant containing a water-soluble polyether compound. The water-based lubricant of the type is noncombustible and its appearance is transparent, and in addition, it is advantageous in that it is highly stable at high temperatures and hardly separates; however, it has some problems in that its lubrication performance is not fully satisfactory and its defoamability is poor.

As opposed to this, the water-based hydraulic pressure fluid containing the water-based lubricant of the present invention is excellent both in the lubrication performance and the defoamability, as compared with the conventional hydraulic pressure fluid containing a water-soluble polyether compound.

In the hydraulic pressure fluid, the hyperbranch-type polyglycerol concentration in use may be generally from 10 to 80% by mass or so, preferably from 30 to 50% by mass.

EXAMPLES

The present invention is described in more detail with reference to the following Examples, by which, however, the present invention should not be restricted at all.

Various properties of hyperbranch-type polyglycerol and various properties of water-based lubricant were determined according to the methods mentioned below.

<Hyperbranch-Type Polyglycerol (HPB-PGR)>

(1) Absolute Molecular Weight M:

The absolute molecular weight of HPB-PGR is measured through size exclusion chromatography on-line multiangle laser light scattering analysis (SEC-MALLS) using the following apparatus under the following condition.

Separation column: Two Tosoh TSKgel $GMPW_{XL}$ columns (linear, 7.5 mm×600 mm; exclusion limit, $5\times10^7$) are used.

Column temperature: 40° C.

Mobile phase solvent: Aqueous $NaNO_3$ solution having a 0.2 mol/L concentration.

Mobile phase flow rate: 1.0 mL/min.

Sample concentration: 3 g/mL.

Sample amount: 100 μL.

Detector 1: Multiangle laser light scattering detector (Wyatt's "DAWN 8").

Detector 2: Viscosity detector (Wyatt's "Viscostar").

Detector 3: Refractive index (RI) detector (Wyatt's "Optilab rEX").

The absolute molecular weight of the EO/PO block copolymer used in Comparative Example and Reference Example and that of PEG used in Comparative Example were measured in the same manner as above.

(2) Limiting Viscosity [η] and Mean Molecular Weight Distribution (Weight-Average Molecular Weight Mw/Number-Average Molecular Weight Mn; Mw and Mn being Standard Polystyrene-Equivalent Data):

These are determined through SEC-MALLS, using the apparatus and under the condition of the above (1).

(3) Degree of Branching (DB):

This is determined according to the method described in this specification.

<Water-Based Lubricant>

(4) Kinematic Friction Coefficient:

Each water-based lubricant is tested in a reciprocating friction test under the condition mentioned below, and its kinematic friction coefficient is determined on the 20th to-and-fro sliding movement.

Reciprocating Friction Test Condition

Ball material: SUJ2 ½ inches

Sliding material: steel sheet (SPCC)

Load: 100 g, 200 g, 500 g

Test temperature: room temperature (23° C.)

Sliding speed: 40 mm/sec

Sliding distance: 40 mm

Sliding frequency: 20 to-and-fro times (5) Defoamability:

According to the defoamability evaluation test described in this specification, each water-based lubricant is evaluated for the defoamability thereof.

Production Example 1

In a round-bottom flask of glass (capacity: 100 mL), boron trifluoride diethyl ether ($BF_3.OEt_2$) (23.2 L, 0.189 mmol) was dissolved in dry dichloromethane (43.1 mL). Glycidol (10 mL, 0.151 mol) was dropwise added to the solution at a speed of 4.8 mL/hr, and under the condition of −20° C., this was stirred at 135 rpm with a motor-powered stirrer (stirring blade: round-type, blade width=65 mm, height=25 mm). After the addition, this was kept stirred for 28 hours, and thereafter the reaction solution was put into methanol with aqueous ammonia, and the reaction was thus stopped. The solvent was evaporated away under reduced pressure, the residue was dissolved in methanol, and recrystallized from acetone to purify the polymer. The process gave hyperbranch-type polyglycerol (HPB-PGR1) having an absolute molecular weight Mw=10,000, a degree of molecular weight dispersion Mw/Mn=3.08, a degree of branching BD=0.51, α=0.18, a limiting viscosity [η]=5.2. Its yield was 91.1%. The data are shown in Table 1.

Production Examples 2 to 4

Production of HPB-PGR's Each Having a Different Absolute Molecular Weight

Under the condition shown in Table 1 and according to the same process as in Production Example 1, HPB-PGR2 having an absolute molecular weight of 15,000 (Production Example 2), HPB-PGR3 having an absolute molecular weight of 21,000 (Production Example 3), HPB-PGR4 having an absolute molecular weight of 136,000 (Production Example 4) were produced. Their yield is shown in Table 1.

The degree of branching (DB), the mean molecular weight distribution Mw/Mn, the limiting viscosity [η] and α of each HPB-PGR are shown in Table 1.

TABLE 1

| | | Production Example | | | |
|---|---|---|---|---|---|
| | | 1 | 2 | 3 | 4 |
| Amount of dichloromethane | (mL) | 43.1 | 43.1 | 140 | 300 |
| Amount of $BF_3$•ethyl ether complex (catalyst) | (μL) | 23.2 | 23.2 | 85.5 | 161.4 |
| | (mmol) | 0.189 | 0.189 | 0.677 | 1.31 |

TABLE 1-continued

| | | Production Example | | | |
|---|---|---|---|---|---|
| | | 1 | 2 | 3 | 4 |
| Amount of glycidol | total amount (mL) | 10 | 10 | 35 | 60 |
| | (mol) | 0.151 | 0.151 | 0.526 | 0.856 |
| | addition speed (mL/hr) | 4.8 | 2.4 | 2.4 | 4.8 |
| | addition time (hr) | 2.1 | 4.2 | 14.6 | 12.5 |
| Total Polymerization Time (hr) | | 30.1 | 32.2 | 42.6 | 60.5 |
| Glycidol/catalyst (by mol) | | 800 | 800 | 780 | 650 |
| hyperbranch-type polyglycerol | yield (%) | 91.1 | 72.8 | 76.3 | 56.4 |
| | absolute molecular weight | 10,000 | 15,000 | 21,000 | 136,000 |
| | degree of branching DB | 0.51 | 0.52 | 0.50 | 0.50 |
| | Mw/Mn | 3.08 | 2.83 | 2.36 | 1.51 |
| | [η] (mL/g) | 5.2 | — | — | — |
| | α | 0.18 | 0.21 | 0.13 | 0.12 |

Example 1

HPB-PGR1 produced in Production Example 1 was dissolved in pure water to prepare a water-based lubricant A-1 comprising an aqueous HPB-PGR1 solution having a concentration of 5% by mass.

Example 2

HPB-PGR2 produced in Production Example 2 was dissolved in pure water to prepare a water-based lubricant A-2 comprising an aqueous HPB-PGR2 solution having a concentration of 5% by mass.

Example 3

HPB-PGR3 produced in Production Example 3 was dissolved in pure water to prepare a water-based lubricant A-3 comprising an aqueous HPB-PGR3 solution having a concentration of 5% by mass.

Example 4

HPB-PGR2 produced in Production Example 2 was dissolved in pure water to prepare a water-based lubricant A-4 comprising an aqueous HPB-PGR2 solution having a concentration of 10% by mass.

Comparative Example 1

Ethylene oxide (EO)/propylene oxide (PO) [EO/PO molar ratio, 8/2] block copolymer having an absolute molecular weight of 10,250 was dissolved in pure water to prepare a water-based lubricant B comprising an aqueous solution of the EO/PO block copolymer having a concentration of 5% by mass.

Comparative Example 2

Polyethylene glycol (PEG) having an absolute molecular weight of 10,000 was dissolved in pure water to prepare a water-based lubricant C-1 comprising an aqueous PEG solution having a concentration of 5% by mass.

Comparative Example 3

Polyethylene glycol (PEG) having an absolute molecular weight of 20,000 was dissolved in pure water to prepare a water-based lubricant C-2 comprising an aqueous PEG solution having a concentration of 5% by mass.

The water-based lubricants produced in the above Examples 1 to 4 and Comparative Examples 1 to 3 were tested for the kinematic friction coefficient thereof and evaluated for the defoamability thereof. The results are shown in Table 2.

TABLE 2

| | | Type of Water-based Lubricant | Polymer of Lubricant Ingredient: absolute molecular weight | Polymer of Lubricant Ingredient: concentration (mas. %) | Kinematic Friction Coefficient on 20th to-and-fro sliding movement: 100 g | 200 g | 500 g | Defoamability: Retention of Foams after 5 seconds |
|---|---|---|---|---|---|---|---|---|
| Example | 1 | water-based lubricant A-1 | 10,000 | 5 | 0.148 | 0.093 | 0.105 | no |
| | 2 | water-based lubricant A-2 | 15,000 | 5 | 0.103 | 0.083 | 0.108 | no |
| | 3 | water-based lubricant A-3 | 21,000 | 5 | 0.103 | 0.105 | 0.102 | no |
| | 4 | water-based lubricant A-4 | 15,000 | 10 | 0.114 | 0.117 | 0.093 | no |
| Comparative Example | 1 | water-based lubricant B | 10,250 | 5 | 0.213 | 0.154 | 0.155 | yes |
| | 2 | water-based lubricant C-1 | 10,000 | 5 | 0.220 | 0.145 | 0.130 | yes |

TABLE 2-continued

| | Type of Water-based Lubricant | Polymer of Lubricant Ingredient: absolute molecular weight | Polymer of Lubricant Ingredient: concentration (mas. %) | Kinematic Friction Coefficient on 20th to-and-fro sliding movement: 100 g | 200 g | 500 g | Defoamability: Retention of Foams after 5 seconds |
|---|---|---|---|---|---|---|---|
| 3 | water-based lubricant C-2 | 20,000 | 5 | 0.197 | 0.133 | 0.121 | yes |

[Notes]
The type of the polymer of the lubricant ingredient of each water-based lubricant is shown below.
Water-based lubricant A-1: HPB-PGR1 (absolute molecular weight = 10,000)
Water-based lubricant A-2: HPB-PGR2 (absolute molecular weight = 15,000)
Water-based lubricant A-3: HPB-PGR3 (absolute molecular weight = 21,000)
Water-based lubricant A-4: HPB-PGR2 (absolute molecular weight = 15,000)
Water-based lubricant B: EO/PO (molar ratio, 8/2) block copolymer having an absolute molecular weight of 10,250
Water-based lubricant C-1: PEG having an absolute molecular weight of 10,000
Water-based lubricant C-2: PEG having an absolute molecular weight of 20,000

As known from Table 2, the water-based lubricants of the present invention comprising a hyperbranch-type polyglycerol (HPB-PGR) as the lubricant ingredient thereof have a significantly low kinematic friction coefficient and exhibit excellent lubrication performance, as compared with the water-based lubricants comprising, as the lubricant ingredient thereof, an ethylene oxide (EO)/propylene oxide (PO) copolymer or polyethylene glycol (PEG) that have heretofore been used as a water-based lubricant, in case where the molecular weight of the individual lubricant ingredient and the concentration thereof are nearly the same between them. In addition, the kinematic friction coefficient of the water-based lubricants of the present invention comprising HPB-PGR tends to decrease with the increase in the molecular weight of the lubricant ingredient in case where the lubricant has the same concentration.

Further, the water-based lubricants of the present invention comprising HPB-PGR exhibit excellent defoamability, as compared with the water-based lubricants comprising EO/PO block copolymer or PEG as the lubricant ingredient thereof.

Reference Example 1

An aqueous solution of 4% by mass HPB-PGR2 having an absolute molecular weight of 15,000 produced in Production Example 2, and an aqueous solution of 4% by mass EO/PO block copolymer having an absolute molecular weight of 3,420 were prepared, and tested for the clouding point thereof. The aqueous HPB-PGR2 solution did not have a clouding point, but the aqueous EO/PO block copolymer solution had a clouding point of 55° C.

This means that HPB-PGR is excellent in the water dilution stability as compared with the EO/PO block copolymer.

INDUSTRIAL APPLICABILITY

The water-based lubricant of the present invention is an aqueous solution type or emulsion type lubricant comprising a hyperbranch-type polyglycerol, and as compared with conventional water-based lubricants comprising an ethylene oxide/propylene oxide copolymer, water-based lubricant of the present invention has a small friction coefficient and is excellent in lubrication performance and defoamability, and is favorable, for example, for a water-based metal processing agent of a hydraulic pressure fluid.

The invention claimed is:

1. A water-based lubricant, comprising water and a hyperbranch-type polyglycerol having an absolute molecular weight of from 5,000 to 500,000.

2. The water-based lubricant of claim 1, wherein the absolute molecular weight of the polyglycerol is from 5,000 to 300,000.

3. The water-based lubricant of claim 1, wherein the degree of branching (DB) of the polyglycerol is within a range of from 0.40 to 0.65.

4. The water-based lubricant of claim 1, wherein the polyglycerol satisfies formula (1):

$$[\eta]=K\cdot M^{\alpha} \quad (1)$$

wherein $\alpha$ is less than 0.5;

$[\eta]$ is the intrinsic viscosity or the limiting viscosity of the polyglycerol;

K is a constant; and

M is the absolute molecular weight of the polyglycerol.

5. The water-based lubricant of claim 1, wherein the polyglycerol is provided through ring-opening polymerization of glycidol with a $BF_3$ complex as an initiator.

6. A water-based metal processing agent, comprising the water-based lubricant of claim 1.

7. A method for working, cutting or grinding a plastic, the method comprising working, cutting or grinding the plastic with a water-based metal processing agent comprising a water-based lubricant which comprises water and a hyperbranch-type polyglycerol having an absolute molecular weight of from 5,000 to 500,000.

8. A hydraulic pressure fluid, comprising the water-based lubricant of claim 1.

9. The water-based lubricant of claim 1, further comprising at least one selected from the group consisting of an oily agent, a friction reliever, an extreme-pressure agent, an antioxidant, a cleaning agent, a dispersing agent, a defoaming agent, a surfactant, a rust inhibitor, a preservative, a corrosion inhibitor, a solvent and a basic compound, wherein the lubricant is an aqueous solution type or an emulsion type lubricant.

10. The water-based lubricant of claim 2, wherein the degree of branching (DB) of the polyglycerol is within a range of from 0.40 to 0.65.

11. The water-based lubricant of claim 2, wherein the polyglycerol satisfies formula (1):

$$[\eta]=K\cdot M^{\alpha} \quad (1)$$

wherein $\alpha$ is less than 0.5;

[$\eta$] is the intrinsic viscosity or the limiting viscosity of the polyglycerol;

K is a constant; and

M is the absolute molecular weight of the polyglycerol.

12. The water-based lubricant of claim 2, wherein the polyglycerol is provided through ring-opening polymerization of glycidol with a $BF_3$ complex as an initiator.

13. A water-based metal processing agent, comprising the water-based lubricant of claim 2.

14. A hydraulic pressure fluid, comprising the water-based lubricant of claim 2.

15. The water-based lubricant of claim 2, further comprising at least one selected from the group consisting of an oily agent, a friction reliever, an extreme-pressure agent, an antioxidant, a cleaning agent, a dispersing agent, a defoaming agent, a surfactant, a rust inhibitor, a preservative, a corrosion inhibitor, a solvent and a basic compound, wherein the lubricant is an aqueous solution type or an emulsion type lubricant.

16. A polymer, comprising a hyperbranch-type polyglycerol of formula (1):

$$[\eta]=K\cdot M^{\alpha} \quad (1)$$

wherein $\alpha$ is less than 0.5;

[$\eta$] is the intrinsic viscosity or the limiting viscosity of the polyglycerol;

K is a constant; and

M is the absolute molecular weight of the polyglycerol.

* * * * *